US006742460B2

(12) United States Patent
Meyer et al.

(10) Patent No.: US 6,742,460 B2
(45) Date of Patent: Jun. 1, 2004

(54) MOLDED PALLET MADE OF RECYCLED MATERIALS

(76) Inventors: Lyle Meyer, 1137 N. Elm St., West Liberty, IA (US) 52776; Gerald Edson, 1537 W. Harlan Dr., Terre Haute, IN (US) 47802

( * ) Notice: Subject to any disclaimer, the term of this patent is extended or adjusted under 35 U.S.C. 154(b) by 56 days.

(21) Appl. No.: 10/190,630

(22) Filed: Jul. 8, 2002

(65) Prior Publication Data

US 2004/0003762 A1 Jan. 8, 2004

(51) Int. Cl.[7] ..... B65D 19/30
(52) U.S. Cl. ..... 108/57.25
(58) Field of Search ..... 108/901, 902, 108/57.25, 57.26, 57.27, 57.28, 51.11, 56.1, 56.3

(56) References Cited

U.S. PATENT DOCUMENTS 3,664,271 A * 5/1972 Wolder et al. ..... 108/57.26
4,674,414 A * 6/1987 Nulle et al. ..... 108/53.3
5,117,762 A * 6/1992 Shuert ..... 108/57.25
5,176,465 A * 1/1993 Holsted ..... 108/56.3
5,666,886 A * 9/1997 Alexander et al. ..... 108/56.3
6,029,583 A * 2/2000 LeTrudet ..... 108/57.25
6,109,190 A * 8/2000 Hale et al. ..... 108/57.25
6,173,659 B1 * 1/2001 Danks et al. ..... 108/54.1
6,305,301 B1 * 10/2001 Piper et al. ..... 108/57.25
6,352,039 B1 * 3/2002 Woods et al. ..... 108/57.25
6,357,366 B1 * 3/2002 Frankenberg ..... 108/57.25

FOREIGN PATENT DOCUMENTS

FR 2703326 * 10/1994

* cited by examiner

*Primary Examiner*—Jose V. Chen
(74) *Attorney, Agent, or Firm*—Daniel O'Connor

(57) ABSTRACT

A compression molded pallet system which may be used as a single layer pallet or converted into a double layer rackable pallet when desired. The pallet is comprised of highly flame resistant materials which are formed from recycled rubber and plastic materials for benefit to the ecology. A novel reinforcing rib pattern is disclosed. Anti-skid elements are also disclosed as a part of the overall system.

1 Claim, 2 Drawing Sheets

FIG. 1.
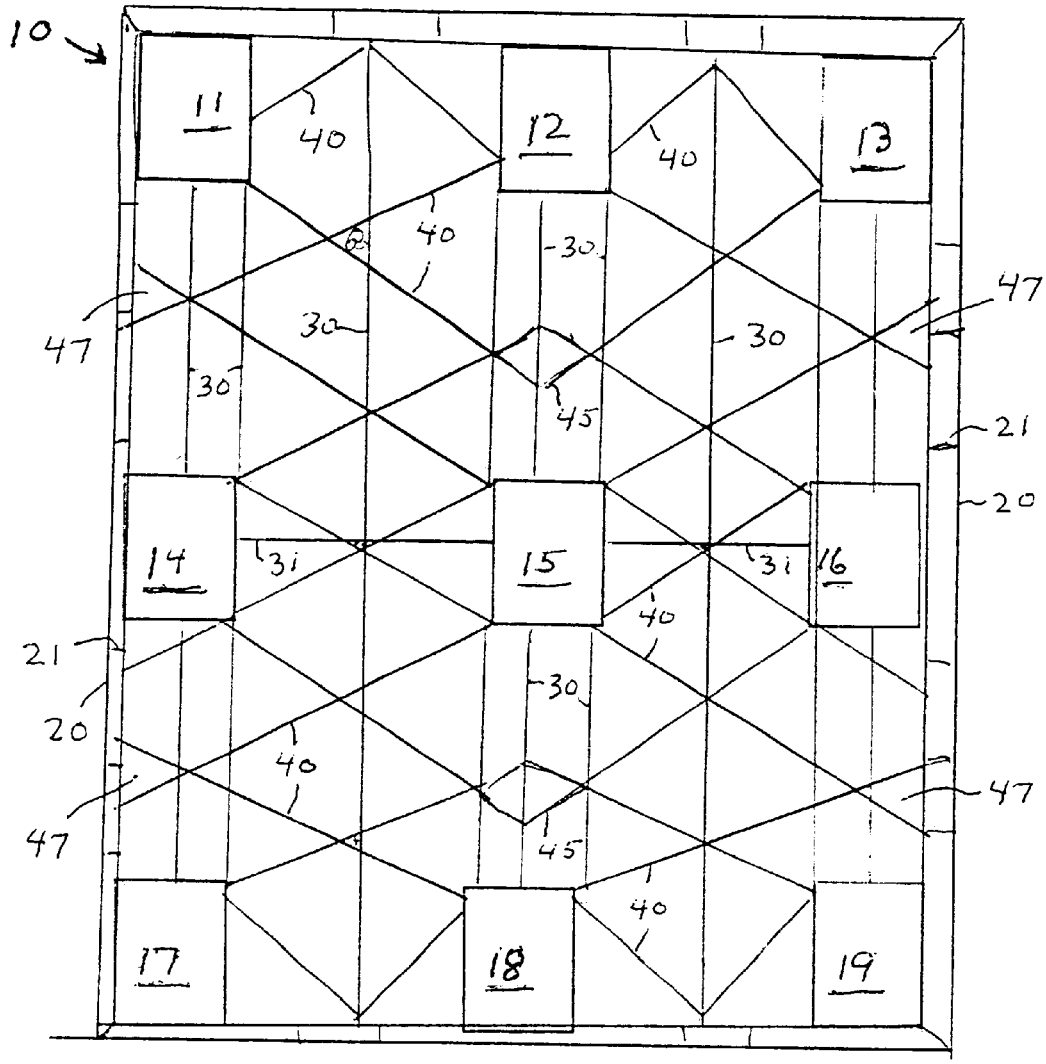
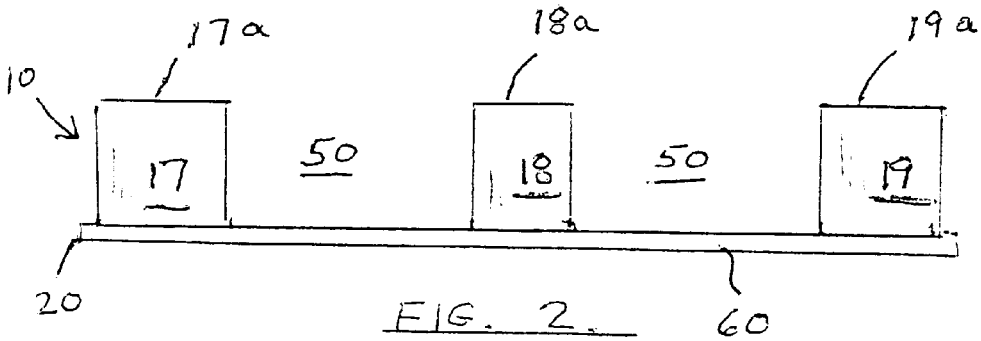
FIG. 2.

MOLDED PALLET MADE OF RECYCLED MATERIALS

BACKGROUND AND OBJECTS OF THE INVENTION

The present invention is related in some aspects to application Ser. No. 09/934,432. The structure disclosed herein is distinct from said prior application.

The present invention is related to the support and pallet arts and, in particular, to a novel pallet system which comprises a single molded layer which may be converted to a double-layer extra-strength rackable pallet.

Plastic formed pallets are known in the art. However, such have proven to be overly costly to manufacture in practice and to lack the strength and performance characteristics necessary for large scale manufacturing and storage projects.

Accordingly, it is an object of the present invention to demonstrate a compression molded pallet made of recycled materials for high strength and economy of manufacture.

It is a further object of the invention to set forth a highly fire retardant pallet system which may be utilized in large-scale warehousing and manufacturing operations.

It is also an object of the invention to show a pallet design with particular rib strengthening features to carry the maximum loads required in typical manufacturing environments.

It is a still further object of the invention to describe a pallet system having open-ended support legs for the purposes of economy of manufacture and easy conversion into a double-layered pallet system when required. Anti-skid elements on top of the pallet are also broadly described and may be the subject of a separate patent application.

These and other objects and advantages of the invention will be apparent to those of skill in the mechanical and manufacturing arts from the description and drawings which follow.

PRIOR ART PATENTS AND DESIGNS

The following U.S. patents are at least broadly related to the present invention.

U.S. Pat. No. 6,357,366 comprises a rackable pallet. The system includes support and reinforcing areas and liquid drainage holes on the top thereof.

U.S. Pat. No. 6,352,039 was issued for a plastic pallet having various support areas.

In contrast, the present invention includes novel reinforcing rib areas and open-ended support legs to allow conversion to a double layer pallet when desired.

The present invention is compression molded from a novel formula comprising recycled rubber and plastic compounds for benefit to the ecology. The formula used has achieved a Class A fire resistance rating.

Anti-skid components are also efficiently molded into the top layer of the invention.

SUMMARY OF THE INVENTION

The pallet disclosed includes nine support legs which are generally rectangular in shape and which are open-ended to provide for inclusion of a second pallet layer when deemed necessary for particular racking demands.

Ribs of about one inch in length are also molded into the bottom of the pallet.

The ribs are placed in particular vertical, horizontal and diagonal configurations to provide maximum strength and anti-bowing features at desired locations.

Outer strengthening ribs with surrounding peripheral edges are also provided.

Anti-skid protrusions are also shown on the top area of the pallet.

The particular recycled, binder and fire retardant compounds are also described along with the broader production methods used.

BRIEF DESCRIPTION OF THE DRAWING FIGURES

FIG. 1 is a bottom view of the pallet system of the invention. The various reinforcing rib configurations are shown as well as the open-ended support legs and the peripheral reinforced ribs in an extended outer area.

FIG. 2 is a side view of the pallet and indicates the elongated support legs and the fork lift aperture areas.

FULL DESCRIPTION OF A PREFERRED EMBODIMENT

Figure 3:
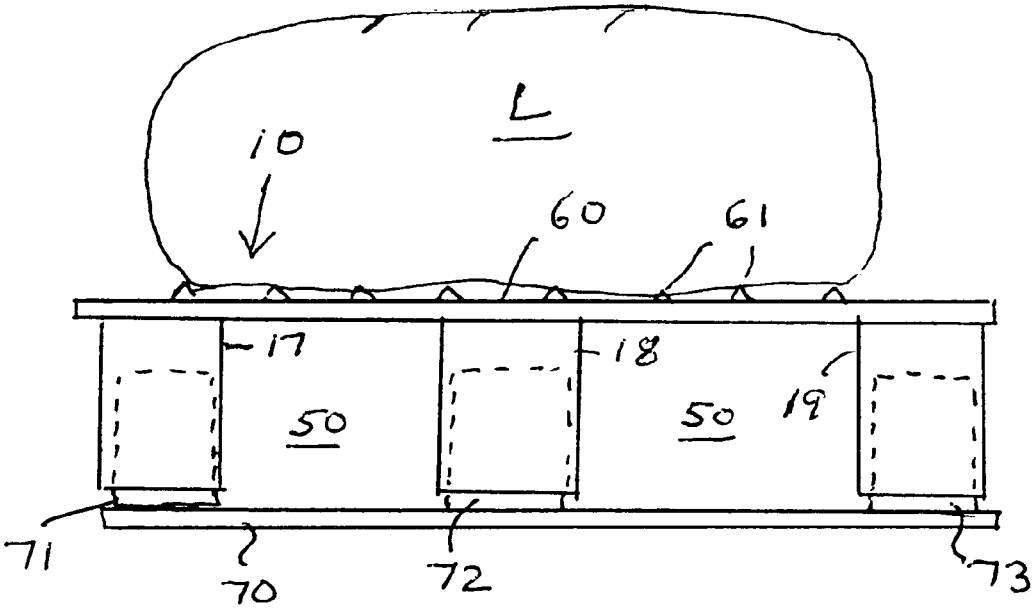
FIG. 3 is a view of the pallet from the side and positioned on a floor area with a load L placed thereon. The use of protruding anti-skid elements is also shown.

Referring to the drawing FIG. 1, a view of the underside of pallet 10 is shown.

The pallet underside includes a number of support legs numbered 11 through 19. The support legs are located as shown in the drawing. The legs 11–19 are on the order of 4 inches in length to provide room for fork lift insertion to be later described.

As further shown in FIG. 1, the pallet underside includes plural vertical ribs indicated at numerals 30.

It is an important aspect of the invention that the ribs 30 as well as the other ribs shown and the legs 11–19 are unitarily formed in a one-step compression molding process for economy of manufacture.

The other strengthening rib elements are also critical and are to be further described herein.

Referring further to FIG. 1, a pair of horizontal ribs 31 are shown between central support legs 14 and 15 and 15 and 16 respectively.

The horizontal ribs 31 provide extra support at a central location of the pallet 10 for extra anti-bowing support of a load L to be further described.

A plurality of diagonal ribs 40 are further shown in FIG. 1. These diagonal ribs 40 generally form diamond or triangular shaped sections for increased support where needed on the pallet underside.

The diagonal ribs 40 are more closely spaced at certain areas of the pallet underside. For example, lateral areas 47 are formed by closely spaced diagonal ribs 40. Such provides increased support in areas of the pallet subject to higher bending stresses.

The central areas 45 are also formed by the close spacing of diagonal ribs 40 to provide more strength where needed in the system.

The pallet 10 further includes peripheral extended sections 20 and smaller ribs 21 positioned around the edges of the pallet. Elements 20 and 21 are also compression molded in a single step manufacturing process. Elements 20 and 21 serve to provide a protective buffer zone for the support legs

11–19. Such results in increased strength and longer useful life for the overall pallet.

Referring to the side view of FIG. 2, the support legs 17, 18 and 19 are shown.

Importantly, the upper areas of legs 17–19 are open-ended as indicated at numerals 17*a*, 18*a* and 19*a*. It is to be understood that the other support legs 11–16 are also open ended.

FIG. 2 further shows peripheral section 20 and a pallet top portion 60.

Numerals 50 indicate areas where fork lift elements may be inserted into the pallet system during movement and manufacturing processes.

FIG. 3 shows a view of the pallet 10 in an upright or working position with a load L placed thereon.

Legs 17–19 are shown. The open-ended nature of legs 17–19 allows a lower pallet section 70 to be coupled with the upper pallet section 10.

The lower pallet section 70 includes legs 71, 72 and 73 which are sized to snugly fit into the upper legs 17–19. Thus, a double layer pallet system is created for increased strength and for advantageous use in racking systems which are subject to higher stress loadings.

As further shown in FIG. 3, the top of pallet 60 has plural protrusions mold formed thereon as shown at numerals 61. The protrusions 61 serve as anti-skid devices for the load L. Such anti-skid feature is important for most storage processes. Other anti-skid methods and designs are available and will be described in a related patent application.

Through lengthy experimentation, applicant has found that the following combination of elements is highly effective for use in a compression molding process to produce the desired pallet system.

EPDM (ethylene propylene diene monomers), scrap from rubber seals or car parts and SBR (styrene butadiene rubber), up to 50% by weight, EVA (ethylene vinyl acetate) and ULDPE (ultra low density polyethylene) at 10–20% by weight, ATH (aluminum tri-hydrate), fire retardant at 35% by weight in combination with 4% by weight zinc oxide, HDPE (high density polyethylene at 10–30% by weight.

This particular blend of materials has received a Class A fire resistance rating.

The mixture is extruded and the extruded mass is placed into a water cooled compression mold producing the desired pallet system. Importantly, the above compound allows the use of compression molding rather than the more complex injection molding processes.

As will be appreciated by those of skill in the art, the pallet 10 may be used by itself or in combination with the lower pallet piece 70. Such results in a system which is highly economical to produce for increased commercial success.

While a particular system and compound has been shown and described, it is intended in this specification to broadly cover all equivalent systems and compounds.

The invention is further defined by the claims appended hereto.

We claim:

1. A pallet system (10) which is compression molded from a mixture of recycled rubber and plastic materials, said pallet system (10) including a plurality of leg elements (11–19) extending from a top wall (60) thereof, said leg elements (11–19) being open-ended at a portion thereof (17*a*, 18*a*, 19*a*) to provide means whereby legs (71, 72, 73) of a lower pallet (70) may be inserted therein for increased racking strength, said pallet system (10) including vertical strengthing ribs (30) molded therein, said pallet system (10) including horizontal ribs (31) formed thereon, said pallet system (10) further including a plurality of diagonal ribs (40) formed thereon, said pallet system (10) including an outer reinforcing ridge (20) thereon with ribs (21) extending toward the pallet, wherein the the top wall (60) of said pallet includes anti-skid elements (61) formed thereon, wherein said diagonal ribs (40) are more closely spaced at lateral areas (47) and at central areas (45) of the pallet system to provide increased support between lateral legs and between central legs of the pallet system, wherein the mixture comprises EPDM, scrap from rubber seals or car parts, SBR at up to 50% by weight, EVA and ULDPE at 10–20% by weight, ATH fire retardant at 35% by weight in combination with 4% by weight zinc oxide and HDPE at 10–30% by weight, wherein the mixture is extruded and the extruded mass is placed into a water cooled compression mold to produce the desired pallet system in an economical manner.

* * * * *